US005522781A

United States Patent [19]

Minoura

[11] Patent Number: 5,522,781

[45] Date of Patent: Jun. 4, 1996

[54] EXERCISE STAND FOR A BICYCLE

[75] Inventor: Koji Minoura, Gifu-ken, Japan

[73] Assignee: Minoura Co., Ltd., Gifu-ken, Japan

[21] Appl. No.: 409,340

[22] Filed: Mar. 23, 1995

Related U.S. Application Data

[60] Division of Ser. No. 175,206, Dec. 23, 1993, Pat. No. 5,433,681, which is a continuation-in-part of Ser. No. 14,684, Feb. 9, 1993, Pat. No. 5,468,201.

[30] Foreign Application Priority Data

| | | | |
|---|---|---|---|
| Dec. 25, 1992 | [JP] | Japan | 4-347239 |
| Apr. 6, 1993 | [JP] | Japan | 5-79840 |
| Apr. 23, 1993 | [JP] | Japan | 5-98219 |

[51] Int. Cl.[6] ..... A63B 21/00; A63B 23/04

[52] U.S. Cl. ..... 482/61; 482/903

[58] Field of Search ..... 482/57, 61, 903, 482/60, 63, 64

[56] References Cited

U.S. PATENT DOCUMENTS

| | | | |
|---|---|---|---|
| 2,261,846 | 11/1941 | Dollinger | 482/61 |
| 3,831,942 | 8/1974 | Del Mar | 482/903 |
| 4,152,617 | 5/1979 | Janson | 482/903 |
| 4,441,705 | 4/1984 | Brown | 482/61 |
| 4,789,153 | 12/1988 | Brown | 482/61 |
| 4,826,150 | 5/1989 | Minoura | 482/61 |
| 4,838,544 | 6/1989 | Sasakawa et al. | 482/903 |
| 4,969,642 | 11/1990 | Phillips | 482/61 |
| 5,051,638 | 9/1991 | Pyles | 482/903 |
| 5,145,078 | 9/1992 | Hannon et al. | 215/252 |
| 5,145,478 | 9/1992 | Minoura | 482/61 |

*Primary Examiner*—Stephen R. Crow
*Attorney, Agent, or Firm*—Hickman Beyer & Weaver

[57] ABSTRACT

A loading apparatus is mounted on a frame which supports a rear wheel of a bicycle. The loading apparatus includes a resistive force generator which has a rotary shaft connected to a drive drum which is pressed against the tire of the rear wheel. The drive drum has a surface which contacts a plurality of circumferentially adjacent block patterns of a tire at each moment. The drive drum is also used as a flywheel for providing the rear wheel of the bicycle with inertial force.

1 Claim, 17 Drawing Sheets

EXERCISE STAND FOR A BICYCLE

This application is a divisional of application Ser. No.: 08/175,206 filed Dec. 23, 1993 now U.S. Pat. No. 5,433,681. This application also claims the priority of Japanese Application Serial Nos. 4-347239, 5-79840 and 5-98219, which are incorporated herein by reference, and which application is also a continuation-in-part of the U.S. patent application Ser. No. 08/014,684 filed on Feb. 9, 1993 now U.S. Pat. No. 5,418,201 which in turn, relates to U.S. application Ser. No. Re. 509,539 filed on Mar. 30, 1990 now U.S. Pat. No. Re. 34479 and U.S. Pat. No. 4,826,150, all of which are incorporated herein by reference.

BACKGROUND OF THE INVENTION

1. Field of the invention

This invention relates to an exercise stand for a bicycle, and more particularly to a bicycle exercise stand which holds the driving wheel of the bicycle clear of the floor surface and exerts magnetic force on the driving wheel so that bicycle pedaling exercise simulates actual cycling.

2. Description of the Prior Art

Using a bicycle as an indoor training apparatus, by holding it in such a way that it cannot move, and pedaling, has been being done for several decades. For this training, a stand which raises the driving wheel (the rear wheel) of the bicycle clear of the floor surface and holds it in such a way that it is free to rotate is necessary.

Prior art exercise apparatuses of this kind include for example those disclosed in U.S. Pat. No. 4,768,782 and U.S. Pat. No. 4,969,642. These stands comprise a horizontally aligned pair of supports mounted in such a way that they project upward from a frame formed of a front/rear pair of tubular members assembled in parallel with each other. The driving wheel (the rear wheel) of the bicycle is placed on a resistance-providing drum rotatably mounted on the frame. With the bicycle in this position, the pair of rotation shafts which project out from both sides of the hub are respectively rotatably fitted into a fixed sleeve and a movable sleeve which extend toward each other from the supports. In this way, the rear wheel is held on the drum by the two sleeves, and a load caused by the resistance of the drum is put on the rear wheel as it is rotated on the resistance-providing drum by the pedaling of the user. As a result, by pedaling with a treading effort corresponding to the load being put on the rear wheel, the user can achieve an exercise effect.

However, in U.S. Pat. No. 4,768,782, while the fixed sleeve is held projecting inward with a fixed length set in advance, the construction of the movable sleeve is such that the portion projecting out of the support can be lengthened and shortened by the operation of a screw. One of the rotation shafts of the rear wheel is fitted into the fixed sleeve, and the movable sleeve is lengthened and fitted onto the other rotation shaft to grip the hub.

In this operation, to set the bicycle on the stand, the user holds the upper part of the rear end of the bicycle with both hands so that the rear wheel, which has been placed on the resistive force generating drum, does not become separated from the drum. At the same time, it is necessary for the user to lengthen the movable sleeve and fit it onto the rotation shaft by operating the screw with another hand stretched down to the lower part of the rear end of the bicycle. Because of this, the task of setting the bicycle on the stand is awkward.

In U.S. Pat. No. 4,969,642, the fixed sleeve is constructed in almost the same way as that described above, and the movable sleeve is constructed in such a way that it can be lengthened and shortened by the operation of a lever. Because of this, it is necessary for the user to position the rear wheel of the bicycle on the drum while holding the bicycle up with one hand, and stretch the other hand to the lower part of the rear of the bicycle to operate the lever. Thus, with the stand of U.S. Pat. No. 4,969,642, as with the stand disclosed in U.S. Pat. No. 4,768,782 mentioned above, the task of setting the bicycle on the stand becomes awkward.

Bicycle exercising stands that have been marketed in the past also include the type shown in FIG. 17. A pair of tubular members 101, 102 which constitute the frame 100 of this stand extend parallel to each other, and two pairs of leg parts 103, 104 (of each pair, only the leg part on the near side is shown in the drawing) which extend diagonally upward are mounted on the ends of the tubular members 101, 102. The leg parts 104 are pivotally supported at the upper portions of the leg parts 103. A pair of holding members 105 (only one is shown in the drawing), for firmly holding the hub 111 of the rear wheel, are mounted at the top ends of the leg portions 103.

A loading device 106 for providing a load resistance corresponding to the rotational speed of the rear wheel 111 is mounted on the tubular member 101, As shown in FIG. 18, the resistance-providing device 106 is made up of a resistance generator 107, having a rotary shaft 108, and a small-diameter drive cylinder 109 which is mounted on the rotary shaft 108 and makes contact with the tire 112 of the rear wheel 111. The resistance generator 107 is constructed in such a way that a pair of permanent magnets are disposed facing each other on either side of a metal rotary disk which is fixed to the rotary shaft 108, and the rotation of the rotary disk along with the rotation of the rotary shaft produces eddy currents in the rotary disk and puts a load on the rotation of the rotary shaft.

After the rear wheel 111 of the bicycle 110 has been placed on the drive cylinder 109, by firmly holding the hub of the rear wheel 111 between the two holding members 105, preparation of the bicycle 110 for exercise is completed. A load resistance corresponding to the rotational speed of the rear wheel 111 rotating along with the rotation of the pedals 113 of the bicycle 110 is generated in the generator 107, and that load resistance is transmitted to the rear wheel 111 through the drive cylinder 109.

In the laoding device 106 described above, when the tread pattern of the tire is of the rib type, continuous in the circumferential direction, the drive cylinder 109 and the tread pattern of the tire are in surface contact at all times as the drive cylinder 109 rotates along with the rotation of the rear wheel 111. As a result, if the rotation of the rear wheel 111 is roughly constant, the rear wheel 111 is continuously provided with a roughly constant load resistance through the drive cylinder 109, and the user can do the pedaling exercise smoothly. And, because the drive cylinder is in surface contact with the tread pattern of the tire at all times, the noise generated by the contact between the two is not great.

However, in the loading device 106 discussed above, the outer diameter of the drive cylinder 109 is small. Therefore, as shown in FIG. 18, when the tread pattern 112*a* of the tire 112 is for example a block type, like the tire of a cross-country bicycle, the drive cylinder 109 does not make surface contact with a plurality of tread patterns 112*a* mutually adjacent in the circumferential direction of the tire 112 simultaneously. Because of this, as the rear wheel 111 rotates, the corner of the pattern 112*a* which comes after the pattern 112*a* which is in surface contact with the drive cylinder 109 collides with the drive cylinder 109. As a result, there is the problem that unevenness occurs in the load resistance with which the rear wheel 111 is provided through the drive cylinder 109, it becomes impossible for the user to do the pedaling exercise smoothly, and the contact between the tire 112 and the drive cylinder 109 produces a loud noise.

SUMMARY OF THE INVENTION

This invention was devised in order to solve the above-mentioned problems associated with conventional products. It is an object of the invention is to provide an exercise stand for a bicycle on which the bicycle can be set up easily.

It is another object of the the invention is to provide an exercise stand for a bicycle for reducing the noise generated by the contact between the drive body and the tire.

It is a further object of the invention to provide an exercise stand enabling the smooth pedaling operation.

In order to achieve the first object mentioned above, in the exercise stand for a bicycle of this invention, there is provided a frame, which is placed on a floor surface, and positioning means, mounted on this frame, with which one side of the hub of the driving wheel of the bicycle is made to abut, for positioning the driving wheel. Also mounted on the frame is gripping means, mounted in such a way that it can pivot between a position in which it faces the positioning means and a clearance position in which it does not face the positioning means, for, when in the position in which it faces the positioning means, pushing the other end of the hub positioned by the positioning means, and, together with the positioning means, rotatably holding the driving wheel clear of the floor. Also, foot-depressed operating means, which is depressed by foot in order to pivot the gripping means, is mounted on the frame.

In an exercise stand for a bicycle constructed as described above, one side of the hub of the driving wheel of the bicycle is caused to abut with the positioning means mounted on the frame placed on the floor, and the driving wheel is thereby positioned. Then, the pedaling means is depressed by foot and the gripping means is pivoted from the clearance position into the position in which it faces the positioning means. When this is done, the gripping means and the positioning means grip the driving wheel and rotatably hold it clear of the floor.

In order to achieve the second object, in an exercise stand for a bicycle according to this invention, in an exercise stand comprising a frame for supporting the driving wheel of a bicycle and a resistance- providing device which has a rotating drive member which, as the driving wheel of the bicycle rotates, rotates in sequential contact with the tread patterns formed on the outer peripheral surface of the tire of the driving wheel, the resistance-providing device being for, through the rotating drive member, providing the driving wheel with a load resistance corresponding to the rotational speed of the driving wheel, the rotating drive member is formed with an outer diameter such that the rotating drive member simultaneously makes surface contact with a plurality of tread patterns mutually adjacent in the circumferential direction of a tire of which the tread pattern is a block type tread pattern.

In an exercise stand for a bicycle constructed as described above, as the driving wheel rotates, the tread patterns formed on the peripheral surface of the tire sequentially make contact with the rotating drive member, and the driving wheel is provided through the rotating drive member with a load resistance corresponding to the rotational speed of the driving wheel. The rotating drive member is formed with its outer diameter such that the rotating drive member simultaneously makes surface contact with a plurality of tread patterns mutually adjacent in the circumferential direction of a tire of which the tread pattern is a block type tread pattern. As a result, the rotating drive member makes surface contact with the tread pattern of the tire at all times, irrespectively of the type of the tire, and if the rotation of the driving wheel is roughly constant, the driving wheel is provided with a roughly constant load resistance and the pedaling exercise can be done smoothly. Also, as the driving wheel rotates, colliding of the corners of the tread patterns, moving along with the rotation of the driving wheel, with the rotating drive cylinder is prevented, and the production of noise is suppressed.

BRIEF DESCRIPTION OF THE DRAWINGS

The invention, together with objects and advantages thereof, may best be understood by reference to the following description of the presently preferred embodiments together with the accompanying drawings, in which:

FIG. 15(*b*) is a view illustrating the state of the flux in the rotary disk when the load being provided to the pedals of the bicycle is roughly half of maximum;

FIG. 15(*c*) is a view illustrating the state of the flux in the rotary disk when the load being provided to the pedals of the bicycle is at its maximum;

DESCRIPTION OF THE PREFERRED EMBODIMENTS

A preferred embodiment of the present invention will now be described in detail, with reference to FIGS. 1 to 16.

Figure 1:
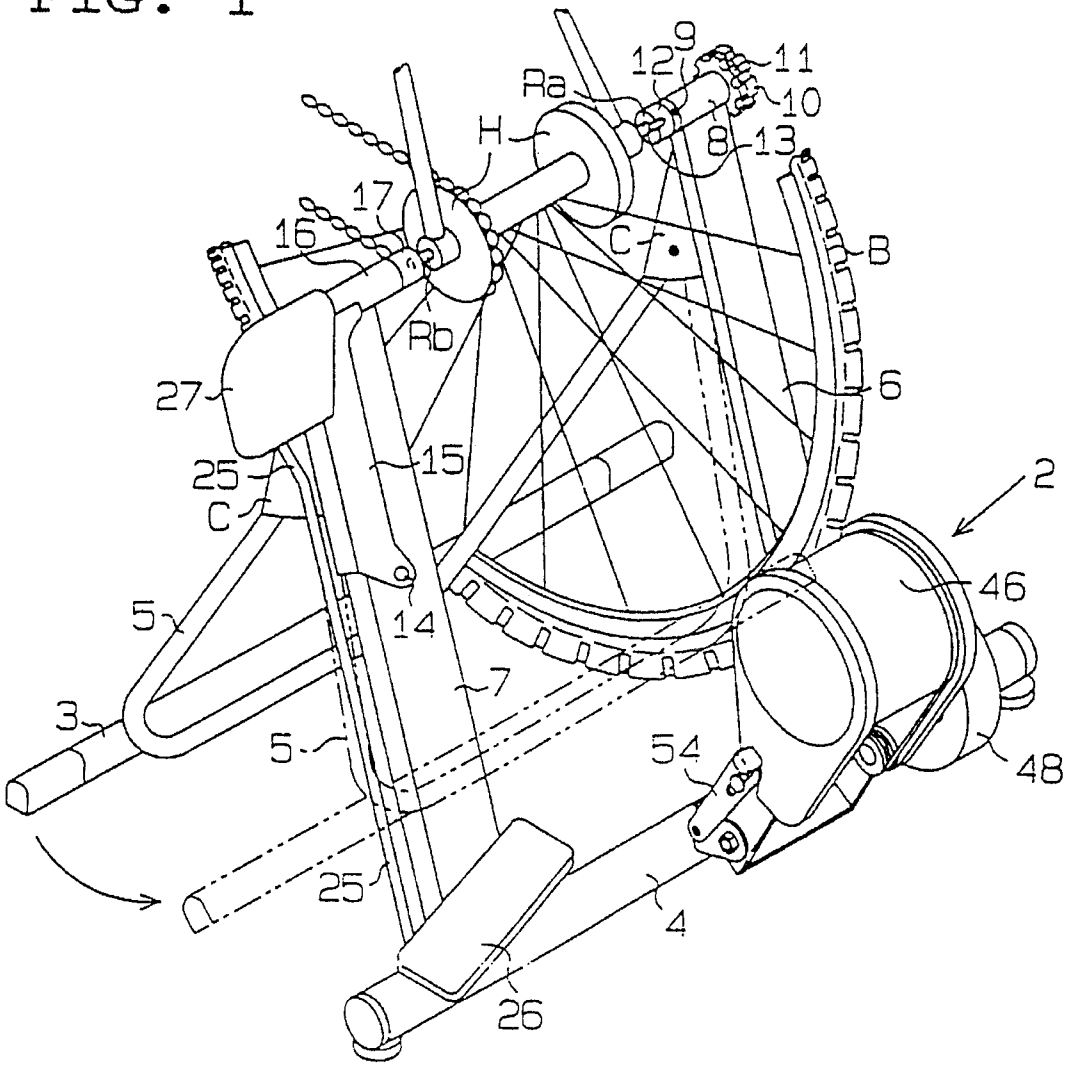
FIG. 1 is a perspective view showing an exercise stand for a bicycle of the present invention together with part of a bicycle.
Figure 2:
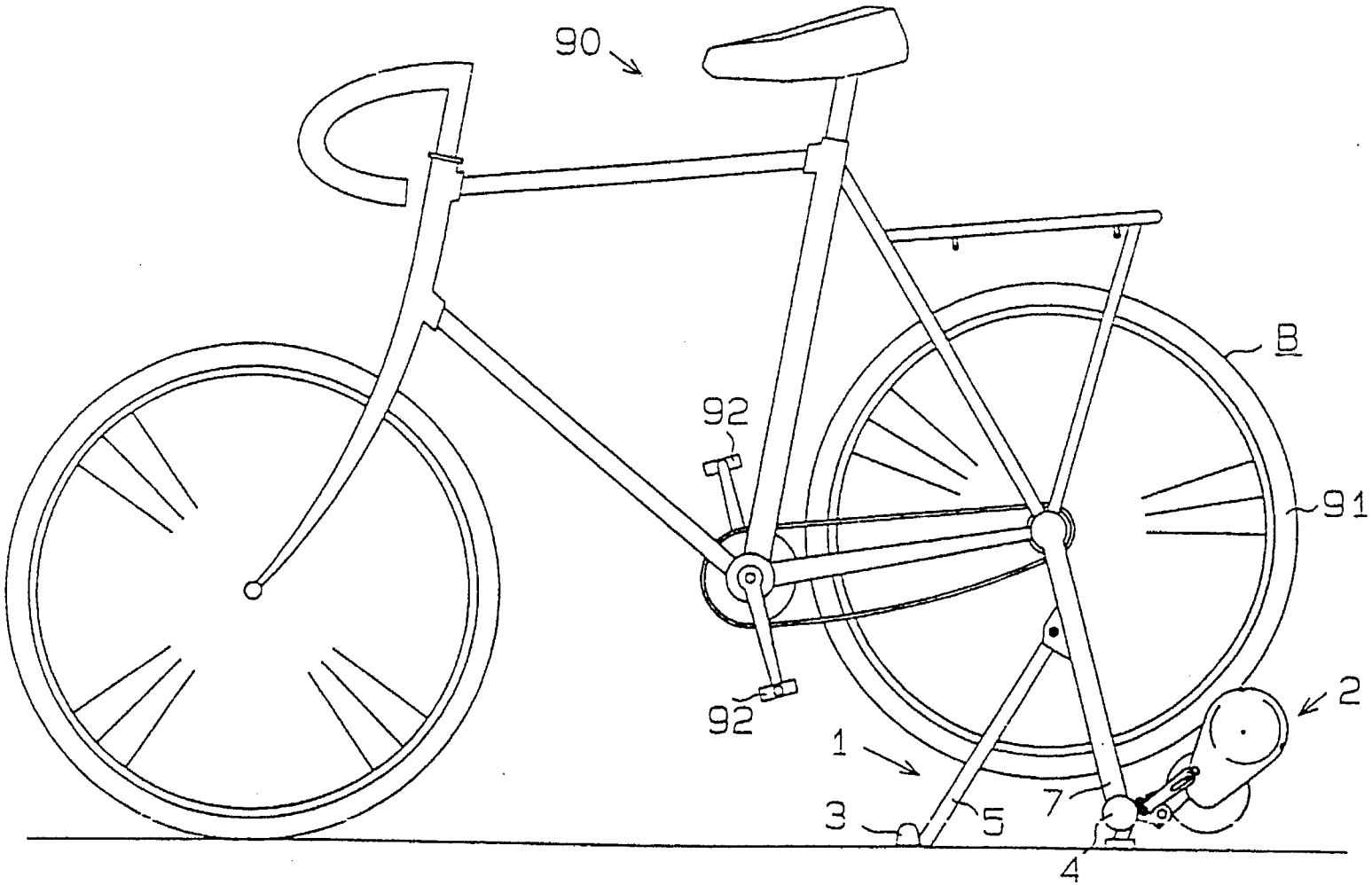
FIG. 2 is a front elevational view showing a bicycle set up on the bicycle exercise stand of the present invention.

FIG. 1 shows an exercise stand for a bicycle set up on a floor surface. A resistance-providing device 2 is attached to a frame 1. Explaining now the frame 1, a front/rear pair of tubular base parts 3, 4 are positioned on the floor surface in parallel with each other.

A U-shaped part 5 is mounted on the front base part 3 in such a way that both its end portions incline upward and rearward. A pair of leg parts 6, 7 are mounted on the rear base part 4 opposite the U-shaped part 5 and extend upward while inclining slightly forward. The U-shaped part 5 is pivotally linked from below to the opposing leg parts 6, 7 through linking pieces C fitted to the upper ends of the U-shaped part 5. At times when the stand of the present preferred embodiment is not being used, the U-shaped part 5 is pivoted as shown by the broken lines in the drawing, and the stand is folded for storage.

A holding cylinder part 8 is mounted on the upper end of the right leg part 6 and extends horizontally along the entire width of the end of the leg part 6. A positioning screw 9 is screwed into the holding cylinder part 8, and the inner end of this positioning screw projects out inward from the holding cylinder portion 8. An adjusting knob 10 is mounted on the outer end (the right-hand end) of the positioning screw 9, and also a locking knob 11 is screw-fitted on the positioning screw 9 between the adjusting knob 10 and the outer wall of the holding cylinder portion 8. A receiving socket 12 is mounted on the inner end of the positioning screw 9, and a receiving concave portion 13 is formed outward from the inner end opening portion of the receiving socket 12.

The extent to which the positioning screw 9 projects from the holding cylinder portion 8 is adjusted in advance according to the size of the bicycle. That is, the adjusting knob 10 is operated and the extent to which the positioning screw 9 projects inward is adjusted according to the thickness of the hub H of the rear wheel B of the bicycle, which is manufactured to conform to predetermined standards. After that, the lock knob is screwed forward and forced against the outer wall of the holding cylinder portion 8 and the positioning screw 9 is locked. In this way, the receiving socket 12 is held unmovably in a fixed position.

A first rotation shaft Ra which projects from the hub H of the rear wheel B of the bicycle is rotatably inserted into the receiving concave portion 13, and positioning of the rear wheel B is thereby performed.

Figure 3:
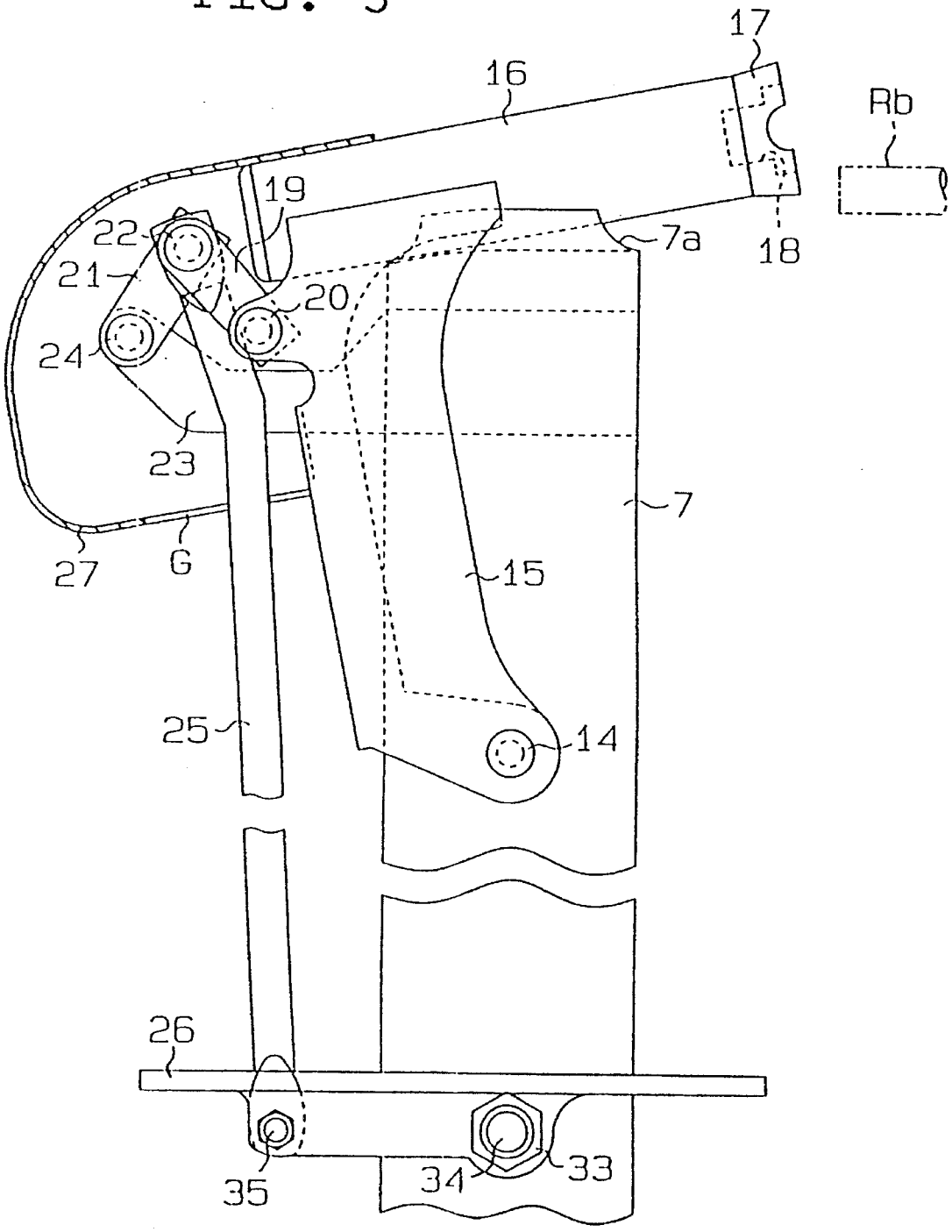
FIG. 3 is a cross-sectional view showing the relationship between the socket and the operating pedal.
Figure 4:
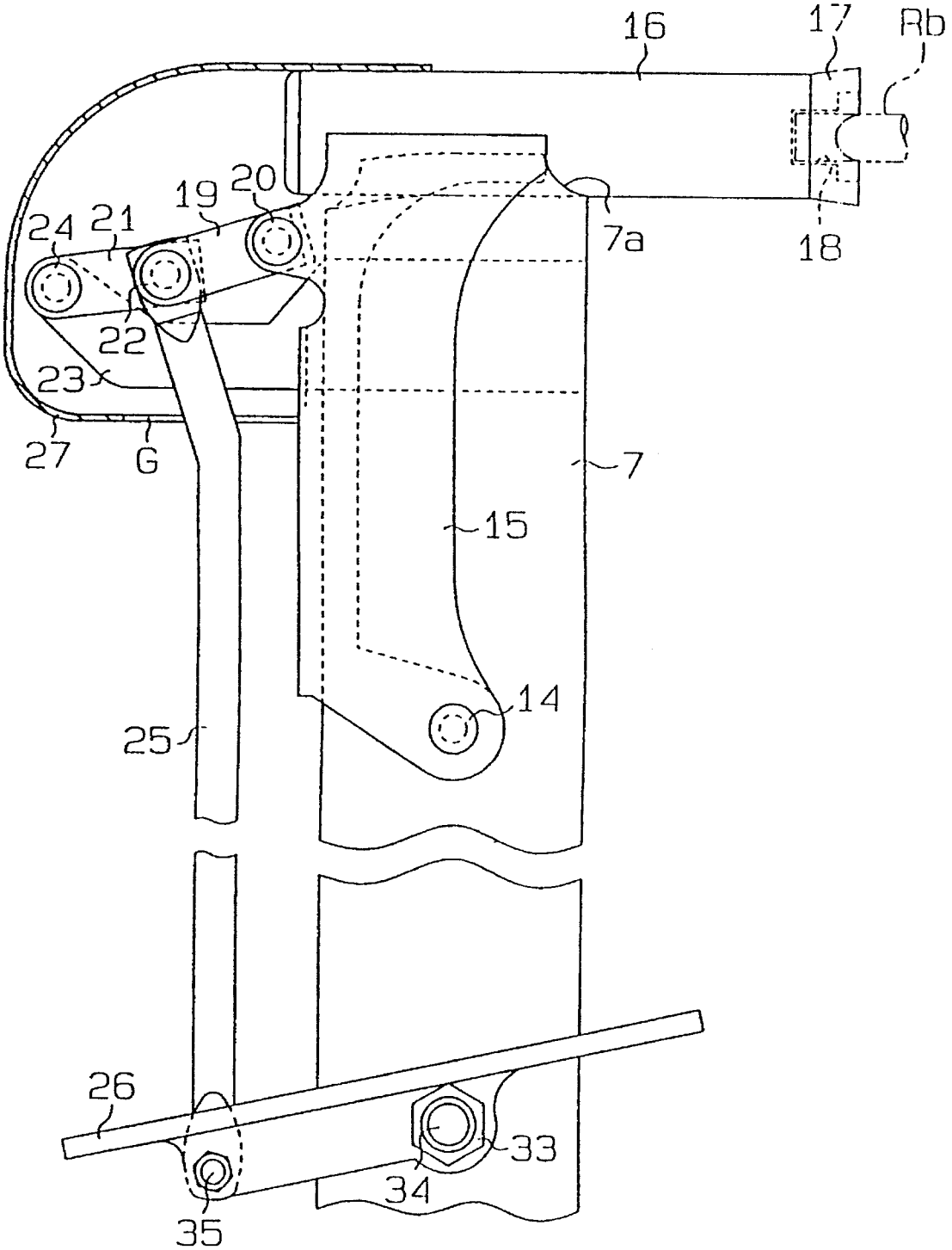
FIG. 4 is a cross-sectional view showing a change in the relationship shown in FIG. 3 between the socket and the operating pedal.
Figure 5:
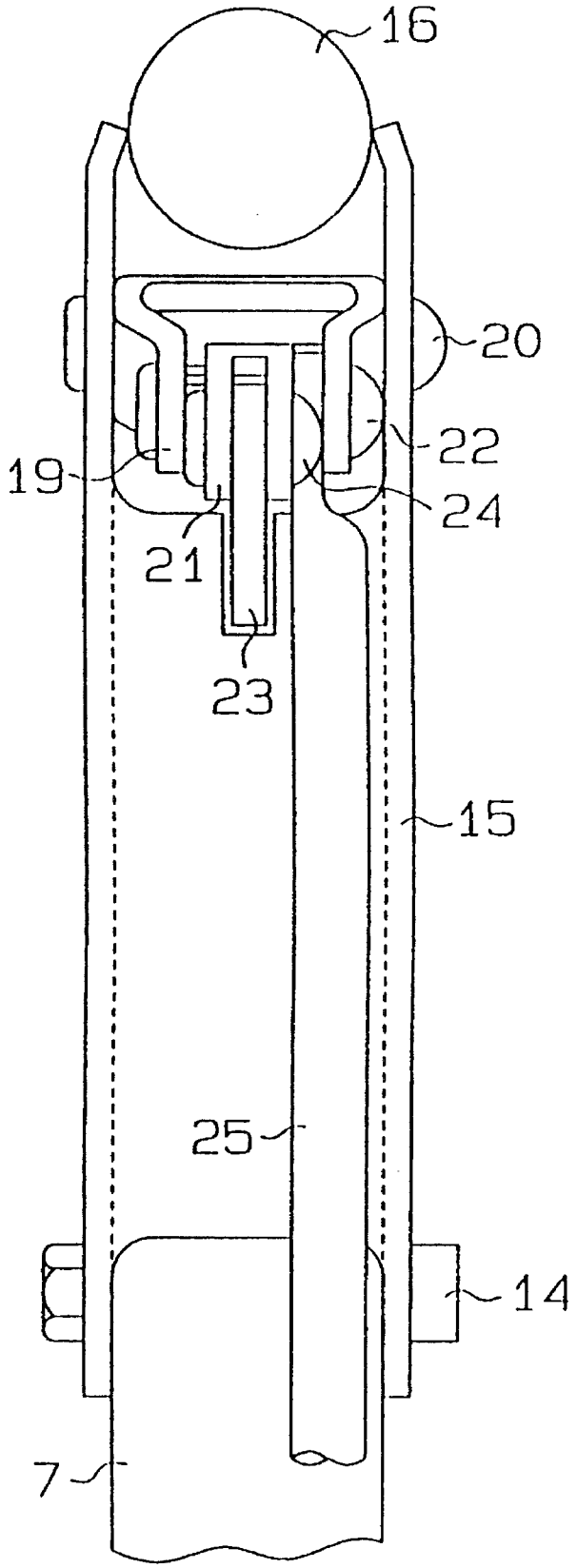
FIG. 5 is an enlarged partial front elevational view of the exercise stand for a bicycle.

As shown in FIGS. 3 and 4, a supporting arm 15 is pivotally attached to the left leg portion 7 by a supporting pin 14. As shown in FIG. 5, the supporting arm 15 is formed in such a way that it covers the outer half (the left half) of the left leg portion 7, and an operating cylinder portion 16 is mounted on the upper portion of this supporting arm 15. The length of the operating cylinder portion 16 is set to be about twice the width of the leg portion 7, and the inner half (the right-hand half) of the operating cylinder portion 16 projects out to the inner side of the leg portion 7. A cutaway portion 7*a* which matches the contour of the outer surface of the operating cylinder portion 16 is formed in the top end portion of the leg portion 7.

As shown in FIGS. 3 and 4, a socket 17 which projects inward from the operating cylinder portion 16 is mounted on the inner end of the operating cylinder 16. A fit concave portion 18 is sunk outward from the inner end surface of the socket 17. As a result, the supporting arm 15 can be pivoted about the supporting pin 14 and its position changed over between a position in which the socket 17 faces the receiving socket 12, as shown in FIG. 4, and a clearance position in which the socket 17 does not face the receiving socket 12, as shown in FIG. 3.

As shown in FIG. 5, the base end of a U-shaped first link 19 is pivotally linked by a supporting pin 20 to the left side of the upper end of the supporting arm 15. A narrower U-shaped second link 21 and a lifting rod 25 are pivotally linked by a supporting pin 22 to the other end of the first link 19 in such a way as to be sandwiched by it. The second link 21 is pivotally linked by a supporting pin 24 to a supporting piece 23, which is mounted on and projects outward from the upper portion of the leg 7, in such a way as to sandwich it. As shown in FIGS. 3 and 4, the supporting piece 23 passes widthways through the leg portion 7 and is welded to the leg portion 7. Also, a platform-shaped recess is cut out of the upper surface of the supporting piece 23, and this recess allows the first and second links 19, 21 to pivot.

The lower end portion of the lifting rod 25 is pivotally linked by a bolt 35 to an operating pedal 26 mounted on the left leg portion 7 below the operating cylinder portion 16.

A plastic cover 27 made of a hard plastic such as polyvinyl chloride is fitted to the operating cylinder portion 16 and the supporting arm 15 in such a way as to cover the first and second links 19, 21 and the supporting piece 23. An opening slot G is formed in the lower portion of this plastic cover 27 to allow the movement of the lifting rod 25.

Figure 6:
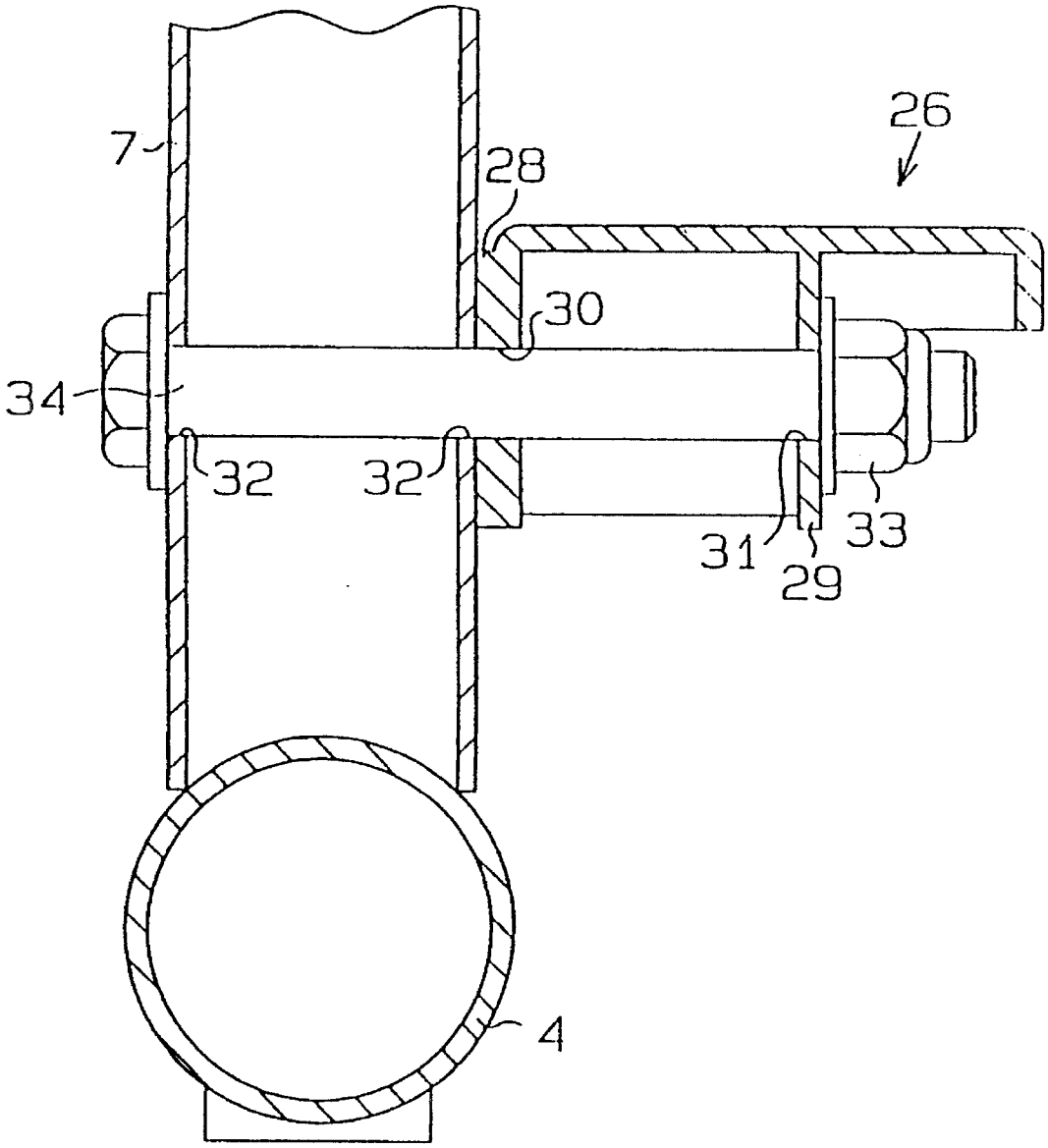
FIG. 6 is a cross-sectional view showing a pedal.

The operating pedal 26 is made of a hard plastic such as polyvinyl chloride, or a metal, formed into a platelike form, and, as shown in FIG. 6, has a thick abutting wall 28 extending downward from its front end (the left end). A mounting wall 29 which projects downward is provided roughly in the central portion, in the front/rear direction, of the pedal 26. A bolt 34 passes from outside the front of the left leg portion 7 through two through holes 32 formed in this leg portion 7 and through fitting holes 30, 31 in the abutting wall 28 and the mounting wall 29. The projecting end of the bolt 34 is fastened by a nut 33, and the pedal 26 is thereby mounted on the left leg portion 7.

The pedal 26 is moved by foot-depressed operation between an inoperative position shown in FIG. 3 and an operative position shown in FIG. 4. When the pedal 26 is in the inoperative position, the first and second links 19, 21 are in an unpivoted position. Consequently, the supporting arm 15 is in a state in which it is inclined with respect to the leg portion 7, as shown in FIG. 3, and the operating cylinder portion 16 and the socket 17 are held in a non-holding position.

When the pedal 26 is operated and moves into the operative position, as shown in FIG. 4, the lifting rod 25 is pulled downward. This causes the first and second links 19, 21 to move into their pivoted positions. When that happens, the supporting arm 15 pivots clockwise about the supporting pin 14 and the operating cylinder portion 16 abuts with the cutaway portion 7*a*, and the operating cylinder portion 16 and the socket 17 move into the gripping position in which they face the receiving socket 12.

The socket 17 is fitted over the second rotation shaft Rb projecting from the hub H of the rear wheel B, and the rear wheel B is rotatably held by the socket 17 and the receiving socket 12. When the first and second links 19, 21 have moved into their pivoted positions, the first and second links 19, 21 lie on a roughly straight line. Because of this, an action restraining force acts on the operating pedal 26 through the supporting arm 15 from the operating cylinder portion 16, and under natural conditions the position of the operating pedal will not changeover.

The loading device 2 will now be described in detail.

Figure 7:
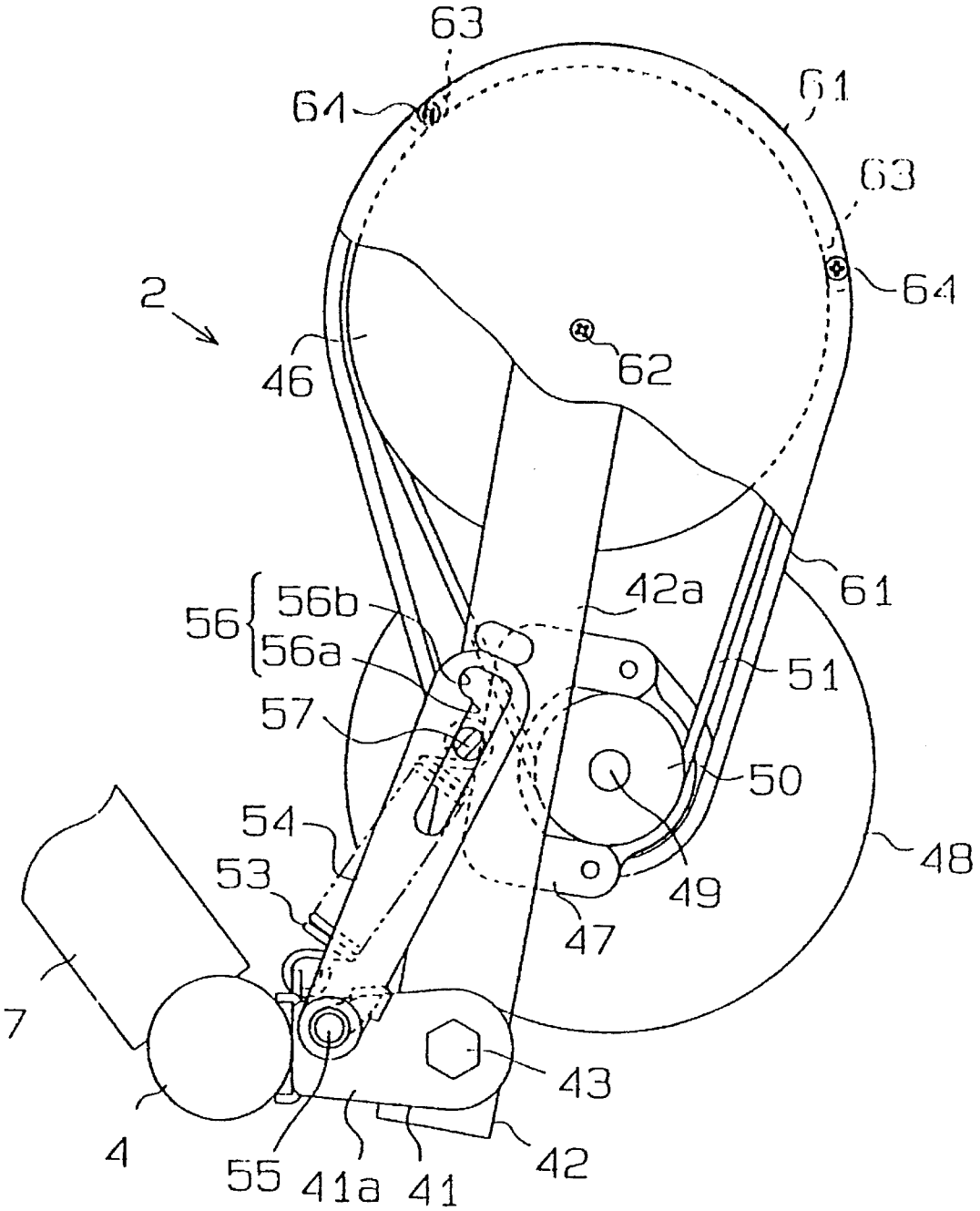
FIG. 7 is a front elevational view showing a loading device of the present invention in the non use position.
Figure 10:
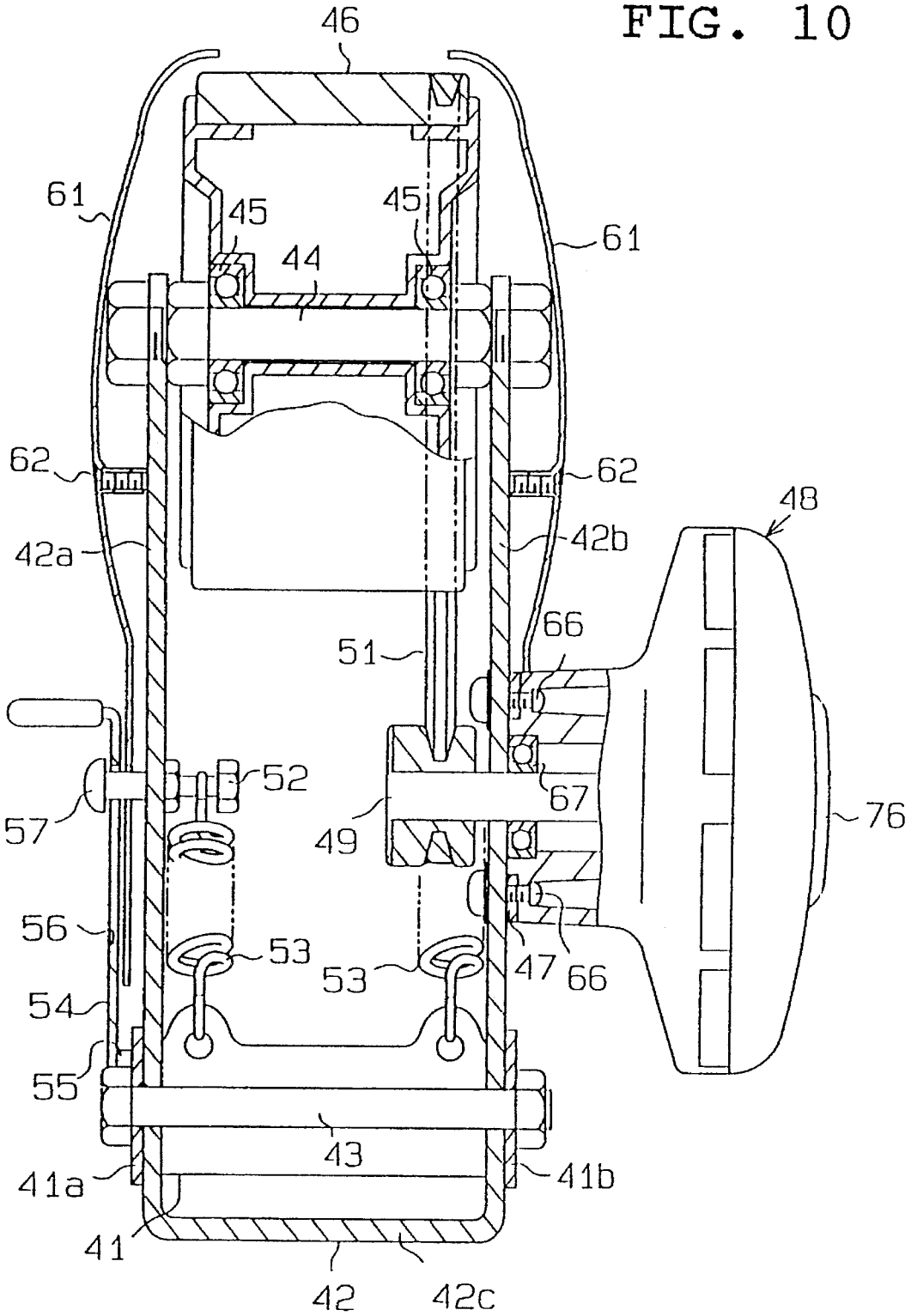
FIG. 10 is a lateral cross-sectional view of the loading device of the present invention.

As shown in FIG. 7, a metal mounting fitting 41 is mounted on the rear base portion 4. As shown in FIG. 10, a pair of opposed supporting pieces 41*a*, 41*b* are formed at the two ends of the metal mounting fitting 41. A metal support fitting 42 is pivotally mounted between the two supporting pieces 41*a*, 41*b* by a bolt 43 near its base portion.

Figure 9:
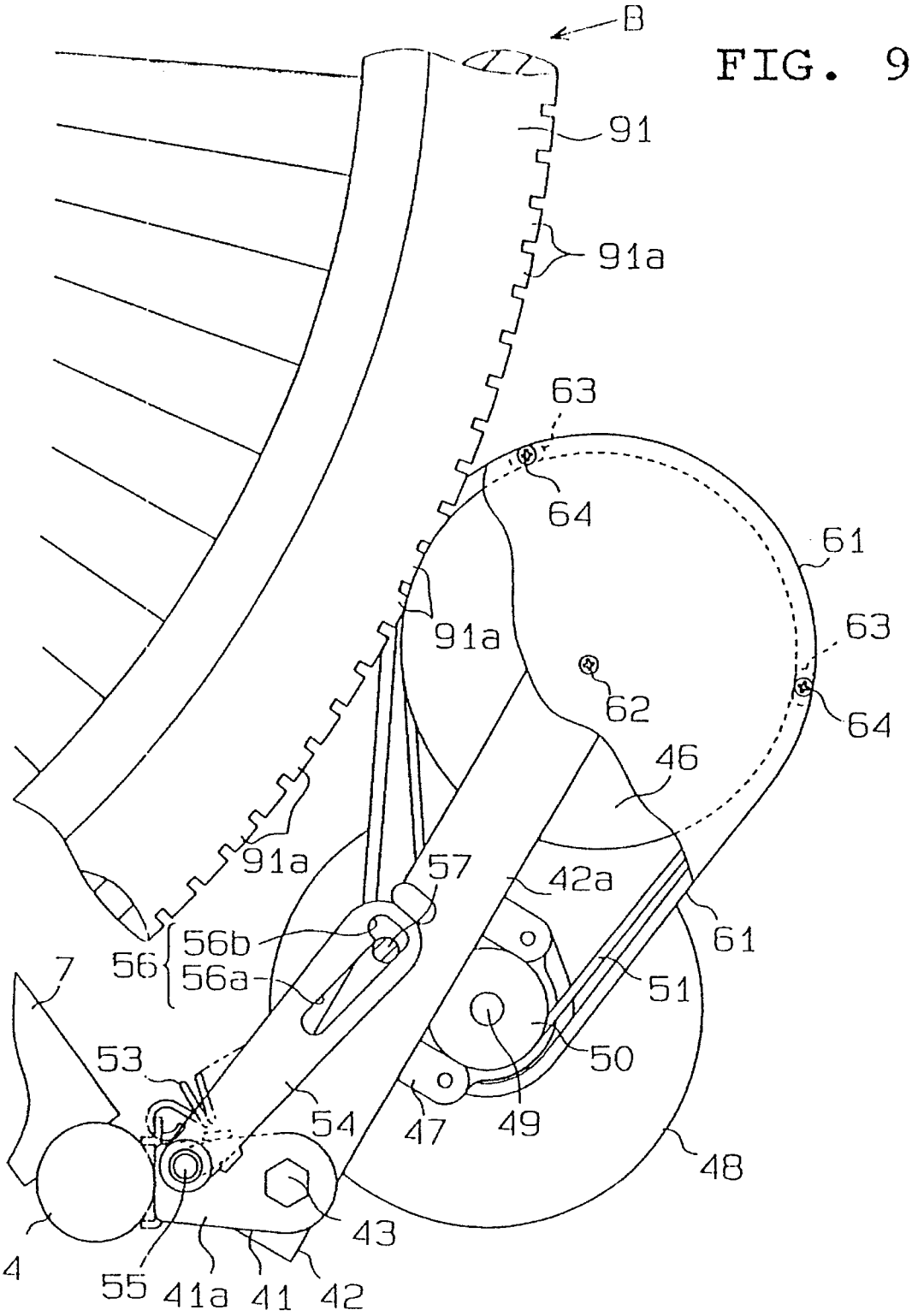
FIG. 9 is a front elevational view showing the loading device of the present invention in the in use position.

The metal support fitting 42 consists of a mutually facing pair of arm portions 42*a*, 42*b* and a linking portion 42*c* which links the two arm portions 42*a*, 42*b* at their bases. A shaft 44 is mounted between the end portions of the arm portions 42*a*, 42*b*. A steel drive drum 46, which also serves as a flywheel, is rotatably supported on the shaft 44 via a pair of bearings 45, and the tire 91 of the rear wheel B of the bicycle 90 makes contact with the outer peripheral surface of this drive drum 46. As shown in FIG. 9, the drive drum 46 is formed with an outer diameter such that the drive drum 46 simultaneously makes surface contact with a plurality (3, in the case of this preferred embodiment) of tread patterns 91*a* mutually adjacent in the circumferential direction of a tire 91 of which the tread pattern is a block type tread pattern, like for example the tire of a cross- country bicycle.

A mounting plate 47 is mounted on the central portion of the arm portion 42*b*, and a resistance generator 48 which generates a load resistance for providing to the rear wheel B is mounted on this mounting plate 47. The rotary shaft 49 of the resistance generator 48 projects out through the arm portion 42*b* side in such a way that it does not interfere with the arm portion 42*b*. A pulley 50 is mounted on the outer end of the rotary shaft 49, and this pulley 50 is drive-connected by a V-belt 51 to the drive drum 46.

Two engaging bolts 52 (only one of which is shown in the drawing) are screw-mounted on the central portions of the insides of the arm portions 42*a*, 42*b*. A pair of tension springs 53 which urge the metal support fitting 42 toward the frame 1 side are strung between the engaging bolts 52 and the metal mounting fitting 41.

Figure 8:
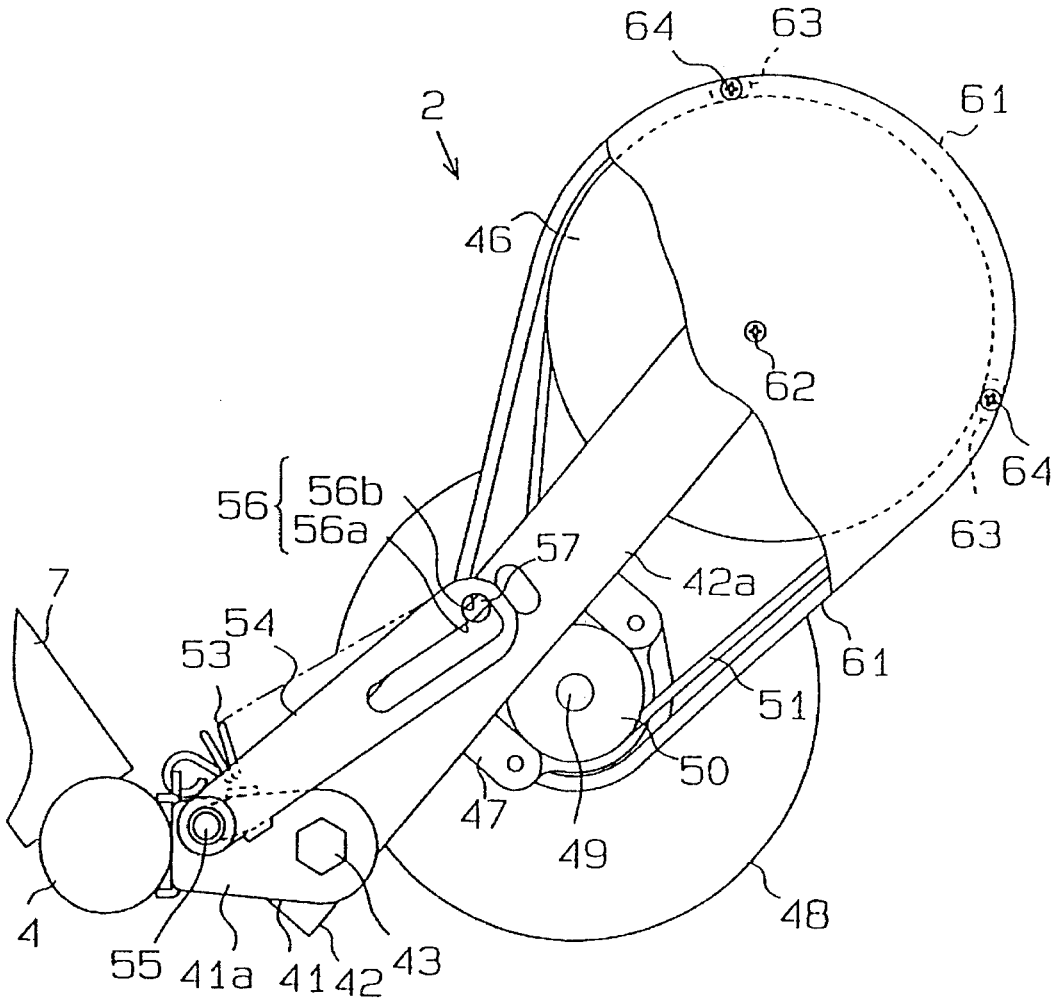
FIG. 8 is a front elevational view showing the loading device of the present invention in the standby position.

As shown in FIGS. 7 to 9, the base end of a holding lever 54 is pivotally supported on the outside of the supporting piece 41*a* by a supporting pin 55. An L-shaped long hole 56, consisting of a guide portion 56*a* which extends toward the pin 55 and a stopper portion 56*b* which intersects with the guide portion 56*a* at the other end of the lever 54, is formed in the holding lever 54. A stopping pin 57, mounted on and projecting outward from the arm portion 42*a*, unremovably passes through the long hole 56, and the stopping pin 57 can move along the long hole 56.

Figure 11:
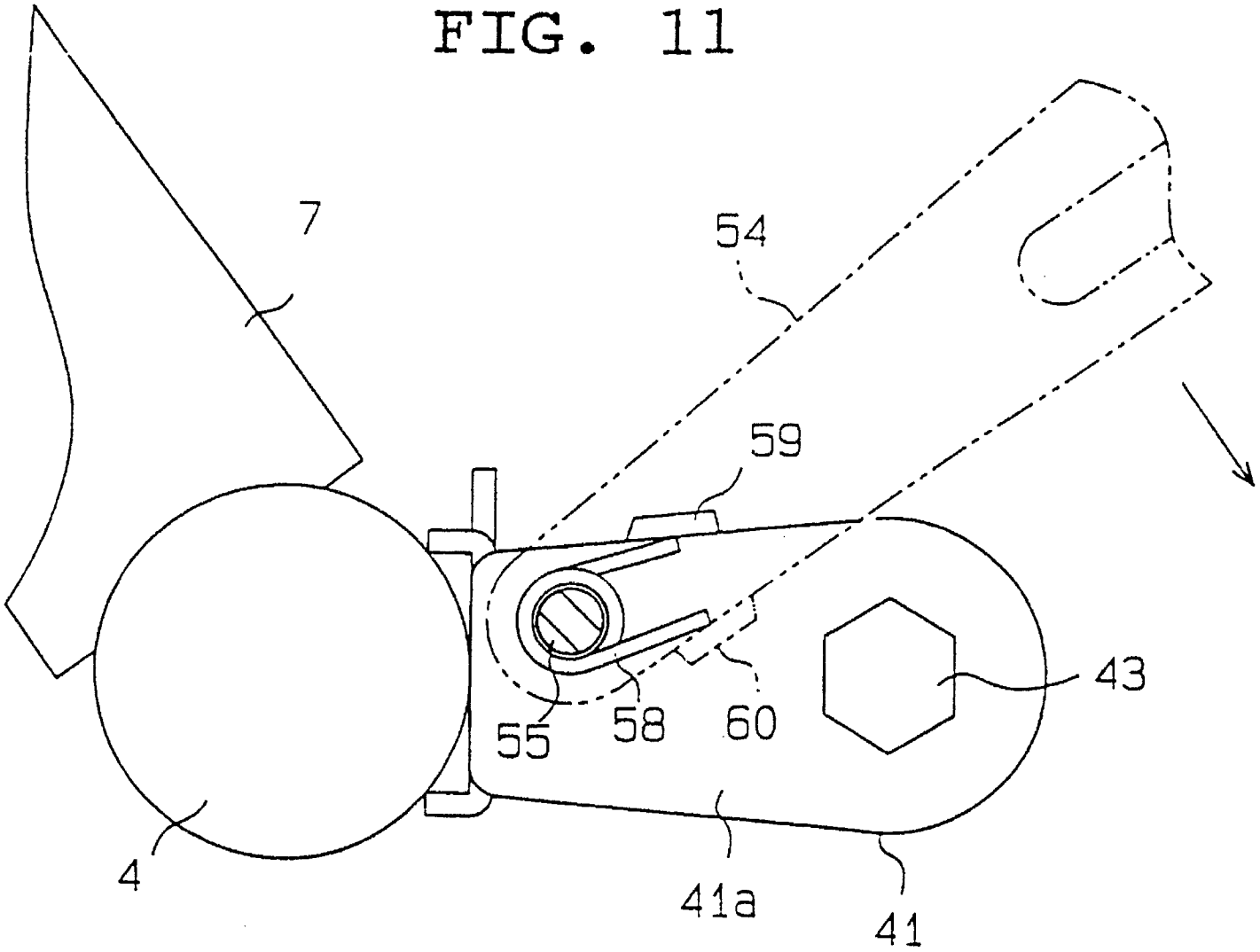
FIG. 11 is an enlarged cross-sectional view showing the relationship between the holding lever and the metal support fitting.

As shown in FIG. 11, a twist spring 58 is interposed between the holding lever 54 and the supporting piece 41*a* on the supporting pin 55. The ends of the twist spring 58 are stopped by a projecting piece 59 formed on the supporting piece 41*a* and a projecting piece 60 formed on the holding lever 54 respectively. The urging force of this twist spring 58 causes the holding lever 54 to be urged toward the metal support fitting 42 at all times.

Consequently, as shown in FIG. 7, when the stopping pin 57 is positioned in the guide portion 56*a*, the metal support fitting 42 is pivoted toward the frame 1 side by the urging force of the twist spring 58. Along with this, the holding lever 54 pivots while allowing the stopping pin 57 to move. And, as shown in FIG. 8, when the stopping pin is in the stopper portion 56*b*, because the movement of the stopping pin 57 is restricted by the stopper portion 56b, the resistance-providing device 2 is held in the standby position shown in FIG. 8.

Plastic covers 61 made of a hard plastic such as polyvinyl chloride are fastened to the outer sides of the arm portions 42*a*, 42*b* by screws 62. Several gap holding plates 63 are fastened between the two covers 61 by screws 64, and these gap holding plates 63 maintain the gap between the two covers 61.

Figure 12:
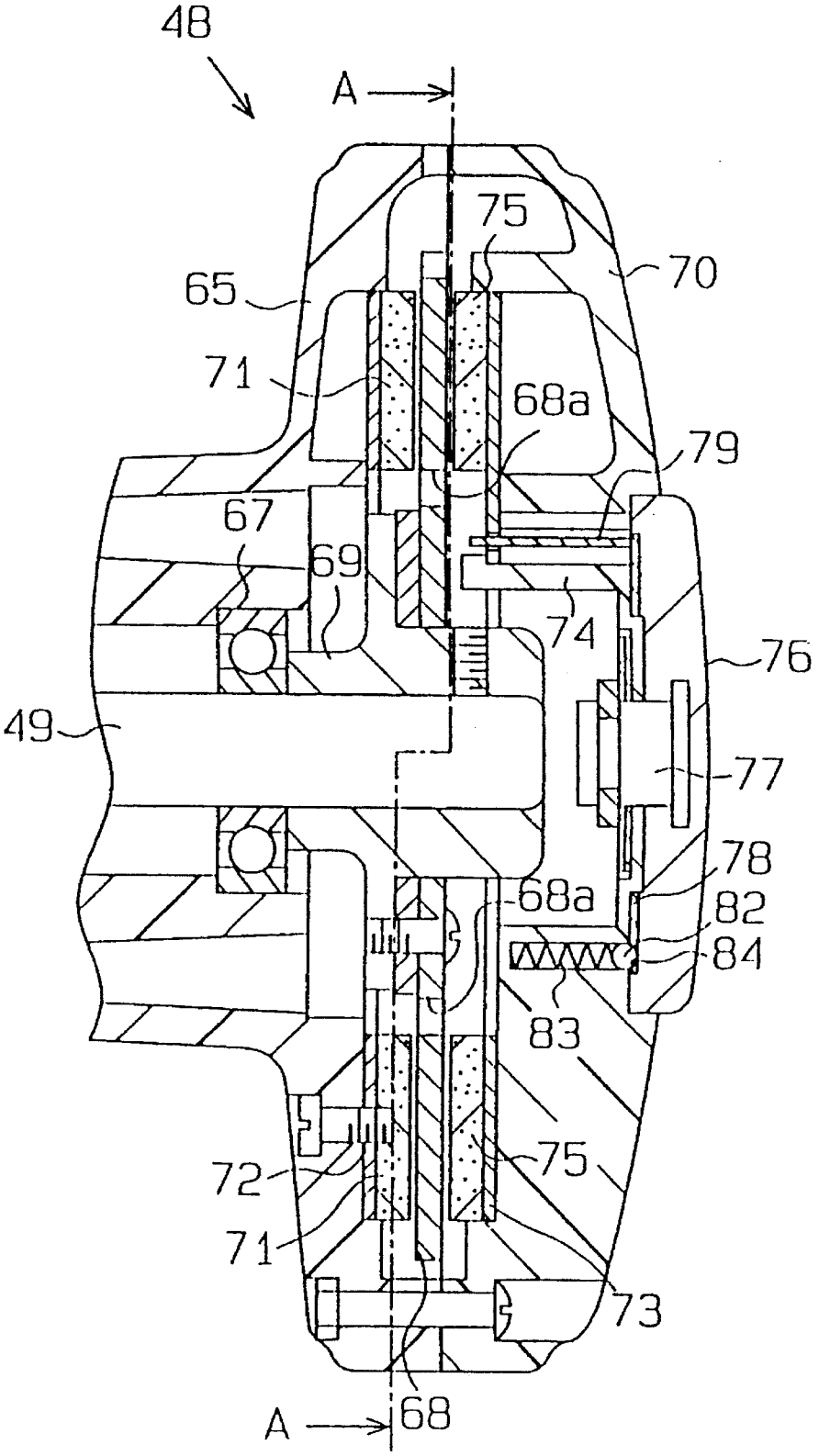
FIG. 12 is a vertical sectional view of the loading device.
Figure 13:
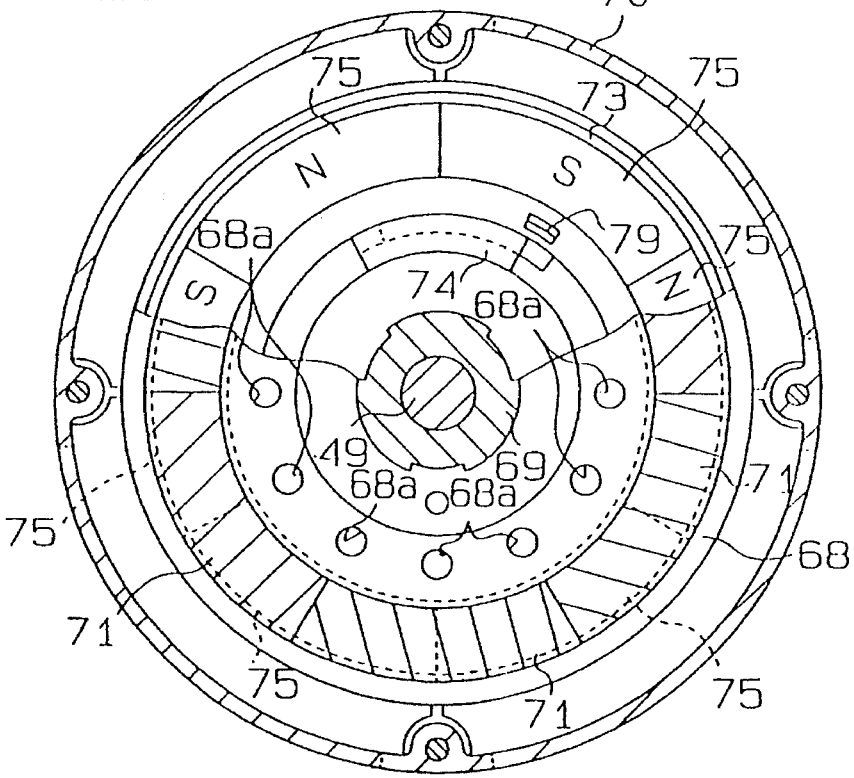
FIG. 13 is a cross-sectional view taken along the line A—A of FIG. 12, showing the arrangement of the permanent magnets.

Next, the resistance generator will be described, with reference to FIGS. 12 to 14. An inner side case 65 is mounted on the mounting plate 47 by means of screws 66. As shown in FIG. 12, the rotary shaft 49 is rotatably mounted in the case 65 by means of a pair of bearings 67. A metal rotary disk 68 is mounted via a bush 69 on the inner end of the rotary shaft 49. A roughly bowl-shaped outer side case 70 is fitted to the inner side case 65 in such a way that the rotary disk is covered on the outer side.

A plurality of fixed-side permanent magnets 71 of circular-arc shape are mounted via a mounting plate 72 on the inner surface of the inner side case 65, in close proximity to the rotary disk 68. As shown in FIG. 13, these permanent magnets 71 are arranged on the mounting plate 72 in a circle in sequence with adjacent poles being alternating.

Several cooling holes 68*a* are formed in the inner peripheral portion of the rotary disk 68, arrayed in the circumferential direction, and these holes prevent overheating of the rotary disk 68.

As shown in FIG. 12, a supporting plate 73 is rotatably supported on the inner surface of the outer side case 70. The supporting plate 73 is held stationary by a plurality of supporting legs 74 mounted on the outer side case. A plurality of movable-side permanent magnets 75 of circular-arc shape are mounted on the supporting plate 73, in close proximity to the rotary disk 68 and facing the permanent magnets 71. These permanent magnets 75 are arranged on the supporting plate 73 in a circle in sequence in such a way that adjacent poles are mutually unlike. The permanent magnets 75 work in conjunction with the permanent magnets 71, when the rotary disk 68 is rotating, to induce eddy currents in the rotary disk 68. A rotation resistance is produced in the rotary disk 68 by these eddy currents, and a load is put on the pedals 92 of the bicycle 90.

Figure 14:
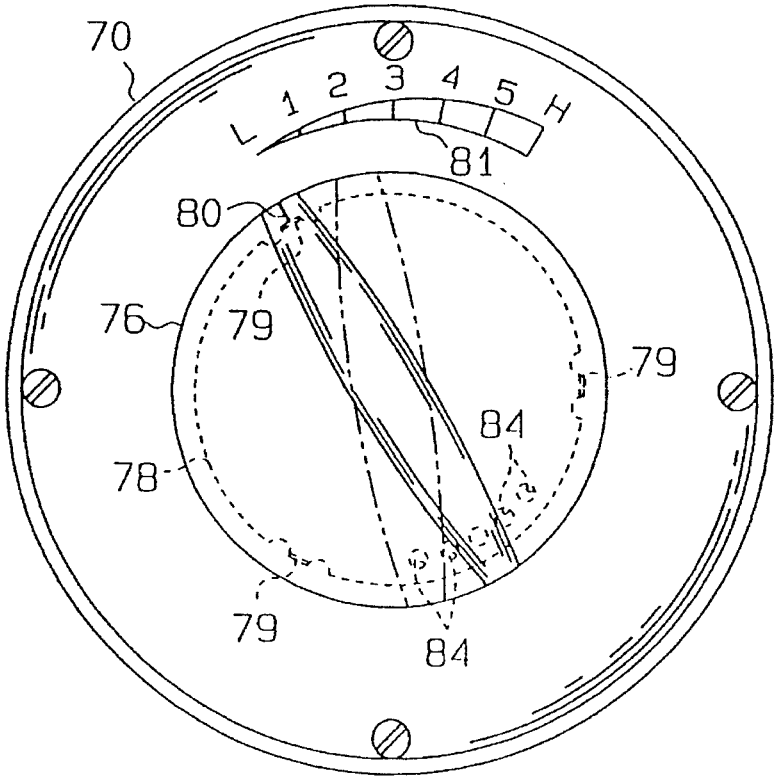
FIG. 14 is a front elevational view of the adjusment knob of the loading device.

As shown in FIG. 14, an adjusting knob 76 for adjusting the load provided to the pedals 92 is mounted on the central portion of the outer surface of the outer side case 70. As shown in FIG. 12, the knob 76 is mounted rotatably with respect to the case 70 on a pin 77. The knob 76 is also linked to the supporting plate 73, via a plurality of linking pieces 79 on a linking plate 78 mounted on the inner surface of the knob 76. A pointer mark 80 is provided on the outer surface of the end of the adjusting knob 76. A graduated scale 81 for indicating the setting of the load provided to the pedals 92 is provided on the outer surface of the outer side case 70 in front of the pointer mark 80.

When the pointer mark 80 is in the position in which it points to the 'L' on the graduated scale, it indicates low load.

In this state, the permanent magnets 75 and the permanent magnets 71 are positioned in such a way that the poles of the magnet end surfaces which face each other are like. When the pointer mark 80 is in the position in which it points to the 'H' on the graduated scale, it indicates high load. In this state, the permanent magnets 75 and the permanent magnets 71 are positioned in such a way that the poles of the magnet end surfaces which face each other are unlike. By turning the knob 76 between the 'H' and 'L' on the graduated scale, the value of the load put on the pedals 92 can be adjusted.

As shown in FIG. 12, an engaging ball 82 and a spring 83 are mounted in the outer surface of the outer side case 70. Because, under the action of this spring 83, the ball 82 is caused to selectively engage with a number of engaging holes 84 provided in the linking plate 78, the permanent magnets 75 are held in the desired setting position indicated by the pointer mark 80.

Next, the operation of the exercise stand constructed as described above will be explained.

To set the bicycle 90 on the stand, first, the loading device 2, which is in its upright position as shown in FIG. 7, is pivoted clockwise (away from the frame 1) against the urging force of the tension springs 53. The stopping pin 57 pivots together with the metal support fitting 42, and the holding lever 54 is caused to pivot clockwise by the engagement of the stopping pin 57 with the guide portion 56*a*. Then, as shown in FIG. 8, when the stopping pin 57 reaches the stopper portion 56*b*, the holding lever 54 is pivoted further clockwise by the urging force of the twist spring 58, and the stopper portion 56*b* fits over the stopping pin 57. Because in this state the movement of the stopping pin 57 is restricted by the stopper portion 56*b*, the loading device 2 is held in the standby position shown in FIG. 8.

With the stand in this state, the rear portion of the bicycle 90 is lifted up, and the first rotation shaft Ra of the rear wheel B is fitted into the receiving concave portion 13 of the receiving socket 12. When the first rotation shaft Ra of the hub H is completely fitted into the receiving concave portion 13, the right-hand side of the rear wheel B is in a state in which it has been positioned by the receiving socket 12 and the positioning screw 9.

After this, the rear portion of the bicycle is carefully held up with both hands so as to keep the rotation shaft Ra held in the receiving socket 12. With the rear end of the bicycle 90 held up, the pedal 2, which is in the inoperative position in which it is shown in FIG. 3, is operated and moved into the operative position in which it is shown in FIG. 4.

This pulls the lifting rod 25 downward, and the first link 19 is pivoted counterclockwise, and the second link 21 is pivoted clockwise. When this happens, the supporting arm 15 is pivoted clockwise about the supporting pin 14, the operating cylinder portion 16 abuts with the cutaway portion 7*a*, the cylinder portion 16 and the socket 17 are moved into the gripping position in which they face the receiving socket 12, and the second rotation shaft Rb of the hub H is received into the fit concave portion 18. As a result, the rear wheel B is rotatably gripped from both the left side and the right side by the socket 17 and the receiving socket 12. In this way, with this frame 1, by the simple operation of depressing the operating pedal 26 by foot after the rear wheel B of the bicycle 90 has been set in the prescribed position on the stand, the rear wheel B can be easily and reliably set in the frame 1.

After that, while pushing downward slightly from above on the drive drum 46, the engagement of the stopper portion 56*b* and the stopping pin 57 is released by pivoting the holding lever 54 counterclockwise against the urging force of the twist spring 58, and the downward pushing on the drive drum 46 is then ceased. When this is done, the resistance-providing device 2 pivots toward the frame 1 under the action of the urging force of the tension springs 53 until the drive drum 46 abuts with the tire 91 of the rear wheel B and pivots no further. This stationary position is the in-use position; the drive drum 46 is pressed against the tire 91 of the rear wheel B by the urging force of the tension springs 53, and the preparatory positioning of the bicycle 90 for exercise is complete. At this time, even if the tread pattern of the tire 91 is a block type tread pattern, the drive drum 46 simultaneously makes surface contact with a plurality of tread patterns mutually adjacent in the circumferential direction of the tire 91.

In this bicycle exercise stand, when the user rotates the pedals 92 of the bicycle 90, the drive power of the rear wheel B is transmitted to the pulley 50 through the drive drum 46, and the rotary shaft 49 is rotated. The rotary disk 68 is rotated integrally with the drive shaft 49. When this happens, eddy currents are induced in the rotary disk 68 by the flux of the permanent magnet arrays 71, 75 disposed on either side of the rotary disk 68, and a resistance is put on the rotation of the rotary disk 68. Consequently, the load resistance of the rotary disk 68 is transmitted from the rotary shaft 49 through the pulley 50 to the drive drum 46, and is further transmitted from the rear wheel B to the pedals 92, and a load resistance is put on the rotation of the pedals 92. The rotation load on these pedals 92 can be adjusted by changing the relative positions of the permanent magnets 71, 75 by operating the adjusting knob 76.

Figure 15A:
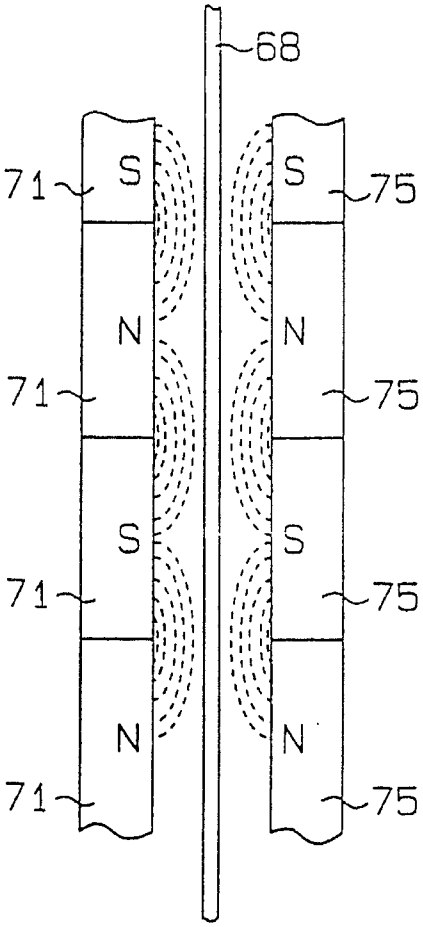
FIG. 15(*a*) is a view illustrating the state of the flux in the rotary disk when the load being provided to the pedals of the bicycle is roughly zero.
Figure 15B:
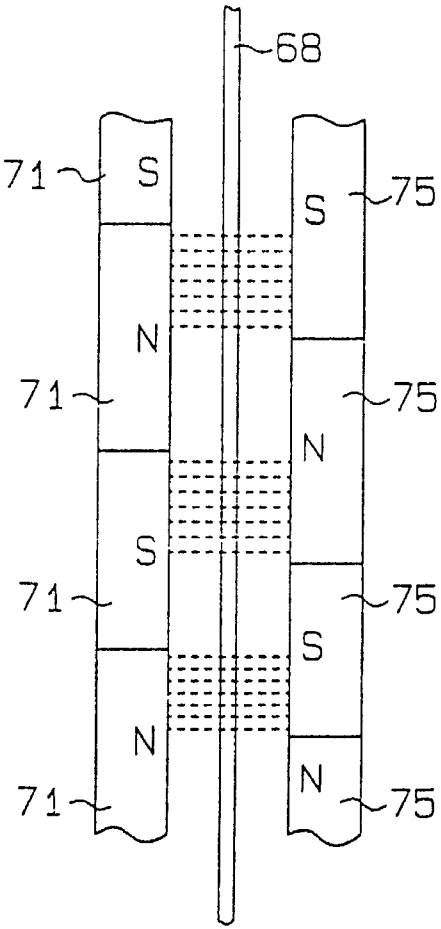
Figure 15C:
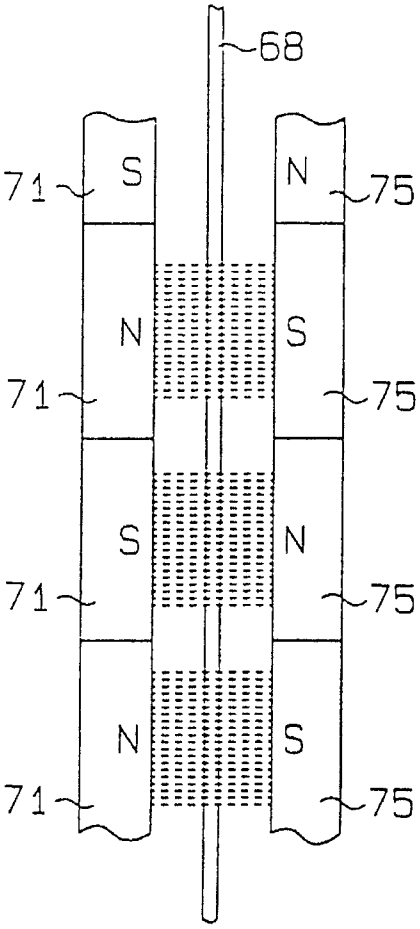

Explaining this in more detail, in the 'L' position of the graduated scale 81, as shown in FIG. 15(*a*), because the permanent magnets 75 are positioned with respect to the permanent magnets 71 in a state in which like poles directly face each other, the flux passing through the rotary disk 68 is almost zero. Eddy currents are produced according to the flux and the rotational motion of the rotary disk 68, and produce a load in a direction which hinders the rotation of the rotary disk 68. Therefore, if the flux is zero, eddy currents are not produced and no resistance is generated.

Figure 16:
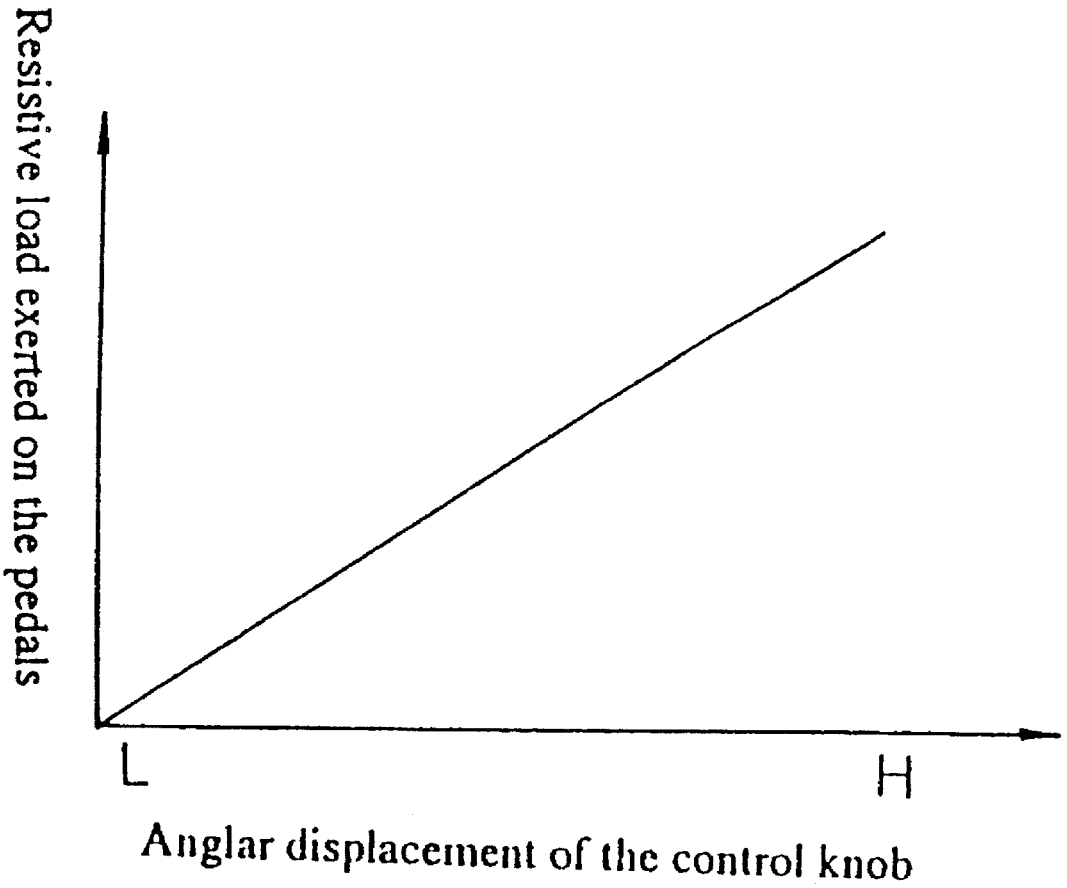
FIG. 16 is a characteristic graph showing the relationship between the setting of the knob and the load provided to the pedals.
Figure 17:
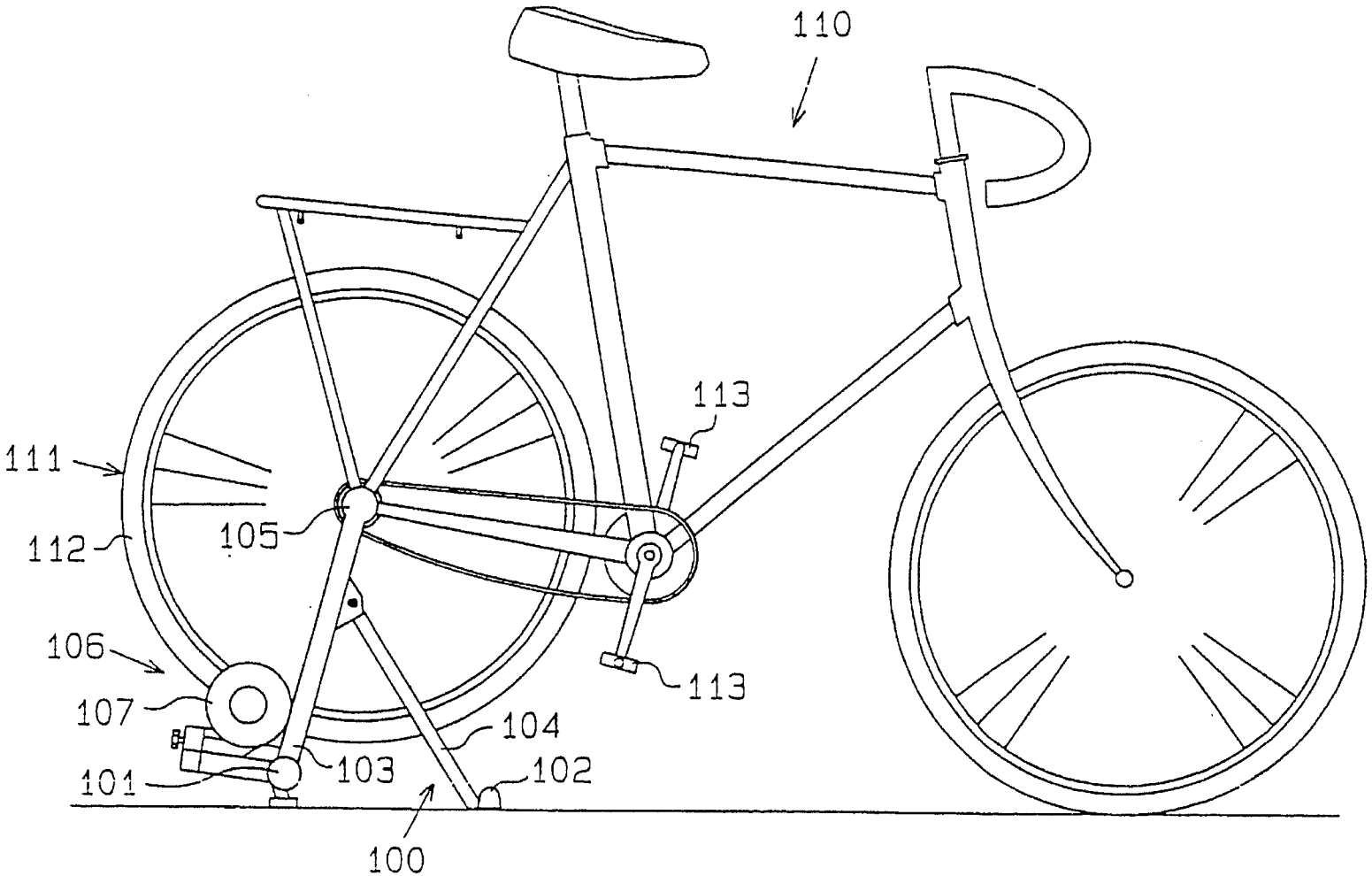
FIG. 17 (PRIOR ART)
FIG. 17 is a front elevational view showing a bicycle set up on a conventional exercise stand.
Figure 18:
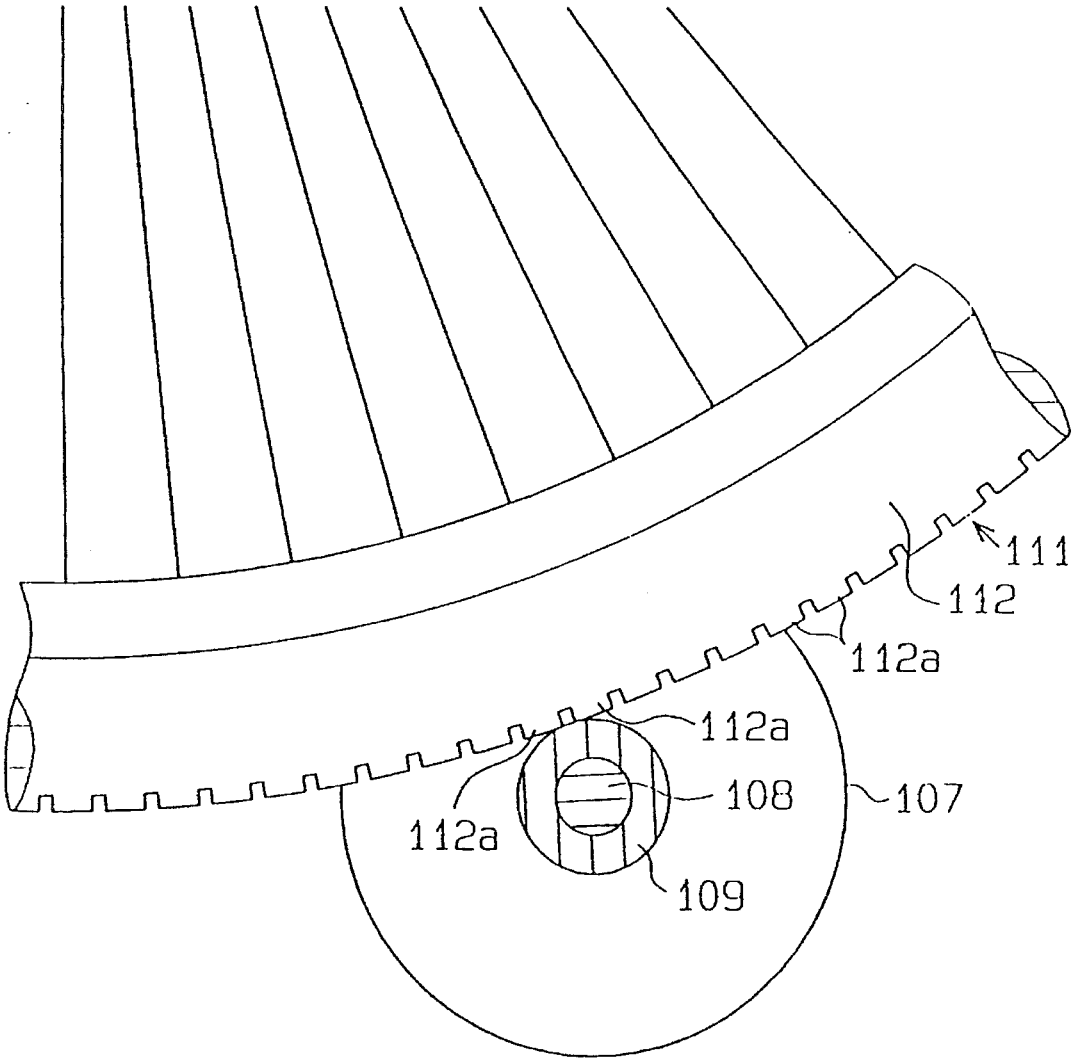
FIG. 18 (PRIOR ART)
FIG. 18 is a cross-sectional view showing the relationship between the drive cylinder and the rear wheel in an example of a conventional loading device.

In the 'H' position of the graduated scale 81, as shown in FIG. 15(*c*), because the permanent magnets 75 are positioned with respect to the permanent magnets 71 in a state in which unlike poles directly face each other, the flux increases and the resistance becomes large. The position of the permanent magnets 75 with respect to the permanent magnets 71 can be moved continuously in the circumferential direction from the state in which like poles face each other, through the state shown in FIG. 15(*b*) which is intermediate between the 'H' and 'L' positions on the graduated scale 81, to the state in which unlike poles face each other. When this is done, the flux increases linearly, and the eddy currents also linearly become greater. Therefore, the load varies linearly with respect to the degree of turn of the adjusting knob 76, as shown in FIG. 16. In this way, in this resistance generator 48, because the load varies linearly with respect to the degree of turn of the adjusting knob 76, the desired load can be easily obtained by turning the adjusting knob 76 according to the graduated scale 81.

Thus, in this preferred embodiment, the resistance-providing device 2 is made up of the resistance generator 48 and the drive drum 46 which is drive-connected to the rotary shaft of the resistance generator 48. And, the outer diameter of the drive drum 46 is such that the drive drum 46 simultaneously makes surface contact with a plurality of tread patterns 91*a* mutually adjacent in the circumferential direction of a tire 91 of which the tread pattern is a block type tread pattern, like for example the tire of a cross-country bicycle. Because of this, the drive drum 46 makes surface contact with the tread pattern of the tire at all times. As a result, the resistance-providing device 2 can provide the rear wheel B with a load resistance without any unevenness, and the pedaling exercise can be done smoothly. Also, collision of the corners of the tread patterns 91*a*, moving along with the rotation of the rear wheel B, with the drive drum 46 is prevented, and the generation of noise by the contact between the drive drum 46 and the tire 91 can be suppressed.

And, in the resistance-providing device 2 of this preferred embodiment, the drive drum 46 is rotatably supported on the metal support fitting 42 pivotally mounted on the frame 1, and there are provided the tension springs 53 which pivot the metal support fitting 42 toward the frame side. The metal support fitting 42 is pivoted by the urging force of the tension springs 53, the drive drum 46 is pushed against the rear wheel B of the bicycle, and the rear wheel B is provided with a load resistance. Because the loading device is constructed in this way, this exercise stand for a bicycle can provide a load resistance to a wheel of any diameter. That is, this stand can be used with any bicycle from an adult's bicycle, with a large wheel diameters to a child's bicycle, with a small wheel diameter.

Also, in this preferred embodiment the drive drum 46 is made to serve also as a flywheel, and the feel experienced by the user of the stand can be made to approach the actual riding feel of a bicycle. And, because the drive drum 46 is made to double as a flywheel, the width dimension of the resistance-providing device 2 can be made small and the overall size of the apparatus can be minimized.

It is to be noted that the bicycle exercise stand of this preferred embodiment can be used to provide a load resistance for bicycles fitted with tires having rib type or lug type tread patterns, as well as those fitted with tires having block type patterns.

It is also noted that this; invention is not limited to the construction of the preferred embodiment described above, and can for example also be practised in the following ways: (1) A timing belt can be used in place of the V-belt 51 which drive-connects the drive drum 46 to the pulley 50. (2) As the resistance generator, a resistance generator which uses a fan of which the air resistance varies with the rotational speed can be used. (3) A resistance generator in which the friction resistance caused by the contact between a brake-providing member and a disc plate mounted on a shaft driven by the rear wheel of the bicycle is automatically adjusted can be used.

It is also possible to make arbitrary changes to the construction of each of the various portions without exceeding the scope of the import of the present invention.

What is claimed is:

1. An exercise stand for supporting a bicycle to facilitate using the bicycle for stationary exercise, said bicycle having a drive wheel and pedals for rotating the drive wheel, the drive wheel having a tire with tread patterns having blocks peripherally disposed on a surface of the tire, said exercise stand comprising:

a frame for supporting the drive wheel of the bicycle;

a drive member carried by the frame and arranged to exert a loading force on the drive wheel that varies in accordance with the rotational speed of the drive wheel, the drive member having an outer peripheral surface with a diameter large enough such that during operation of the bicycle the outer peripheral surface of the drive member simultaneously is in contact with a plurality of the blocks that are mutually adjacent in a circumferential direction of the tire, and wherein the drive member also serves as a flywheel;

a tension spring coupling the frame with the drive member, said tension spring being arranged such that during operation of the bicycle a tension force impels the outer peripheral surface and the drive wheel to maintain contact;

a rotary shaft connected to the drive member for generating a resistive force in accordance with the rotation of the rotary shaft;

a belt connecting the rotary shaft and the drive member;

a rotary disk secured, to the rotary shaft for use in generating the resistive force; and a pair of eddy current generators for generating an eddy current on the rotary disk, each eddy current generator including a plurality of magnets being continuously and circularly arranged whereby the adjacent magnets have alternating polarities, wherein when the rotary disk is rotated an eddy current is generated in the rotary disk by the eddy current generators thus imparting a resistive force to the drive member which in turn exerts the loading force on the drive wheel.

* * * * *